United States Patent [19]

Gorlov

[11] Patent Number: 5,026,203

[45] Date of Patent: Jun. 25, 1991

[54] FRICTION REDUCTION FOR TERRORIST VEHICLE ARRESTING SYSTEM

[75] Inventor: Alexander M. Gorlov, Brookline, Mass.

[73] Assignee: Flexible Barricades, Inc., Watertown, Mass.

[21] Appl. No.: 495,265

[22] Filed: Mar. 16, 1990

[51] Int. Cl.[5] ..... E01E 13/00

[52] U.S. Cl. ..... 404/6; 404/15

[58] Field of Search ..... 404/6, 15, 12, 128; 49/49, 131

[56] References Cited

U.S. PATENT DOCUMENTS

| | | | |
|---|---|---|---|
| 1,357,860 | 11/1920 | Goodrum | 404/15 X |
| 1,649,877 | 11/1927 | Walston | 404/15 X |
| 4,367,975 | 1/1983 | Tyers | 404/6 |
| 4,687,370 | 8/1987 | Knowles | 404/15 |
| 4,759,655 | 7/1988 | Gorlov | 404/6 |
| 4,818,137 | 4/1989 | Gorlov | 404/6 |
| 4,923,327 | 5/1990 | Gorlov | 404/6 |

*Primary Examiner*—Ramon S. Britts
*Assistant Examiner*—Nancy P. Connolly
*Attorney, Agent, or Firm*—Robert K. Tendler

[57] ABSTRACT

A friction-reduction system for causing the front wheels of a terrorist vehicle to leave the ground during sideward deflection of a terrorist vehicle by an arresting system which includes a rigid immovable crash barrier positioned at one side of a driveway and a deflector positioned at the other side of the driveway. In one embodiment the friction-reduction system includes a transverse ridge or bump across the driveway just before the point of impact of the deflector such that the front wheels of the speeding vehicle leave the ground at the time of impact and following deflection. This minimizes the physical pressure on the deflector making it possible to provide a lighter and more efficient deflector and one which assures deflection of the vehicle. In another embodiment, a ramp with a transverse drop off is used in place of the ridge; with the ramp either rising or dropping away just ahead of the deflection point.

6 Claims, 8 Drawing Sheets

FRICTION REDUCTION FOR TERRORIST VEHICLE ARRESTING SYSTEM

FIELD OF THE INVENTION

This invention relates to a method and apparatus for thwarting terrorist attempts at penetrating a gate across a driveway and more particularly to an improved system for arresting vehicles which assures deflection of a vehicle into a crash barrier.

BACKGROUND

In the past there have been various vehicle barriers placed directly across roadways to prevent vehicle penetration. One of the difficulties associated with such barriers is that the barrier must be removably placeable across a roadway. Thus, the barrier must be massive enough to arrest a vehicle, yet light enough to be removed for regular vehicular traffic.

In contradistinction to the above methods of arresting a vehicle, as discussed in Pat. Application Ser. No. 310,735 filed Feb. 13, 1989, now Pat. No. 4,923,327, by Alexander Gorlov incorporated herein by reference, a vehicle is deflected from its direction of travel through the utilization of a turnstile, which is moveable into the roadway to deflect the vehicle into a crash barrier to the side of the driveway. The turnstile/cam in one embodiment, includes a sector of a spoked wheel having as a central hub a freely rotatable cylindrical section, with the hub spokes projecting out beyond the sector to engage the vehicle as it comes into contact with the sector. When such occurs the sector continues to rotate in the direction down the driveway to present increasing portions of the sector to the vehicle and further deflect the vehicle off the roadway.

The turnstile is normally at a rest position, with the sector being completely removed from the driveway. Upon impending impact of an unauthorized vehicle, means are provided to rotate the sector at least partially into the driveway where it is hit by at least a portion of the vehicle coming through the entrance to the driveway. Here the kinetic energy of the vehicle further swings the rotatable sector towards the center of the driveway for assured vehicle deflection. This turnstile therefore redirects the initial vehicular motion along the direction of the driveway and causes the vehicle to be cammed into a different direction, that being in the direction of an immovable crash-barrier. Preferably the vehicle comes to rest straddling the driveway to prevent further unauthorized traffic from coming through the gateway.

The aforementioned terrorist vehicle-arresting system thus includes a crash barrier positioned at one side of a driveway and a turnstile having a circular sector positioned at the other side of the driveway in such a manner that upon entrance of an unauthorized vehicle through a corresponding gate across the entrance of the driveway, means are provided to rotate the turnstile such that the turnstile deflects the vehicle into the crash barrier.

Having described the basic operation of a system for deflecting terrorist vehicles into a crash barrier utilizing a turnstile/cam, it will be appreciated that in view of the impulse delivered by the truck to the turnstile and in view of the fact that all tires are in firm frictional contact with the pavement, the turnstile of necessity needs to be somewhat massive, both as to the sector itself and as to the hub and bearing assembly associated with the sector. Moreover, the radial spokes need to be sufficient strength so as not to crumple or deform upon impact of the vehicle with the sector.

Thus, in order to ensure that the vehicle is in fact deflected, it is necessary that all mechanical components of the system be of sufficient strength to, for instance, deflect a 12 ton truck impacting the deflection system at greater than 45 miles per hour.

SUMMARY OF THE INVENTION

In order to reduce the massive nature of the deflection system necessary and to assure deflection of any unwanted vehicle which comes down the driveway, in the subject system, means are provided to make sure that the front wheels of the vehicle leave the road surface just ahead of the point that the vehicle is to impact the deflector. The front tires of the vehicle are thus not in frictional contact with the driveway, which means that it is considerably easier to deflect the forward portion of the vehicle laterally towards the crash barrier than would be the case with the front wheels of the vehicle tracking on the driveway. The front wheels of the vehicle can be made to leave the driveway by providing a very imperceptibly rising ramp of approximately 5 inches in approximately 5 to 8 feet, which drops away thereafter at a ridge which runs across the driveway. Thus, fast traveling of vehicles will jump the ridge, with the front wheels in the air at the time that the rotatable sector contacts the front portion of the vehicle. It has been found that only a slight rise is necessary, such that the rise is imperceptible to normal vehicular traffic and in fact is unnoticed.

However, for vehicles traveling in excess of 45 miles an hour, especially a 12 ton truck, it has been found through experimentation that the front wheels do in fact leave the roadway surface for a sufficient time to permit the deflection of the front portion f the vehicle through the utilization of the turnstile or other deflector means. In one experimental embodiment, the transverse ridge is located 1 or 2 feet ahead of the deflector impact point, with the front wheels of the vehicle leaving the pavement for approximately 5 to 8 feet. While the length of time that the vehicle's wheels leave the pavement is indeed dependent upon the speed of the vehicle, as a practical matter, for any vehicle traveling above, for instance, 25 miles an hour, the vehicle's front wheels will leave the pavement for a sufficient time to enable friction-free deflection of the front end. At this point the vehicle pivots on its back wheels or tires which offer very small, if any, lateral resistance to the deflection of the front end of the vehicle.

Rather than providing a slightly rising ramp ahead of the impact point, the roadway may be level, with the roadway dropping away from the transverse ridge. The result is the same in that the wheels of the vehicle leave the pavement which permits ready deflection by less massive deflection means than would be possible if the front wheels of the vehicle were allowed to remain in contact with the driveway.

In an alternative embodiment, so-called "speed bumps" may be utilized, with a single speed bump being sufficient to provide for the disengagement of the front wheels of the vehicle from the driveway. However it is preferred that a plurality of transverse speed bumps be placed together in order to ensure that the wheels leave the ground at any speed. Because speed bumps normally provide for speed control for authorized vehicles, they will be ignored by terrorists as the vehicle speeds towards its intended destination. The slower the speed there is less frictional resistance since the front wheels will have time to turn toward the force leading to the crash bumper.

In summary, a friction reduction system is provided for causing the front wheels of a vehicle to leave the ground during deflection.

In one embodiment the friction reduction system includes a transverse ridge or bump across the driveway just ahead of the point of impact of the deflector with the vehicle, such that the front wheels of the speeding vehicle leave the ground at the time of deflection. This minimizes the physical constraints on the deflector and assures deflection of the vehicle.

BRIEF DESCRIPTION OF THE DRAWINGS

These and other features of the Subject Invention will be better understood in connection with the Detailed Description taken in conjunction with the Drawings of which.

DETAILED DESCRIPTION

Figure 1:
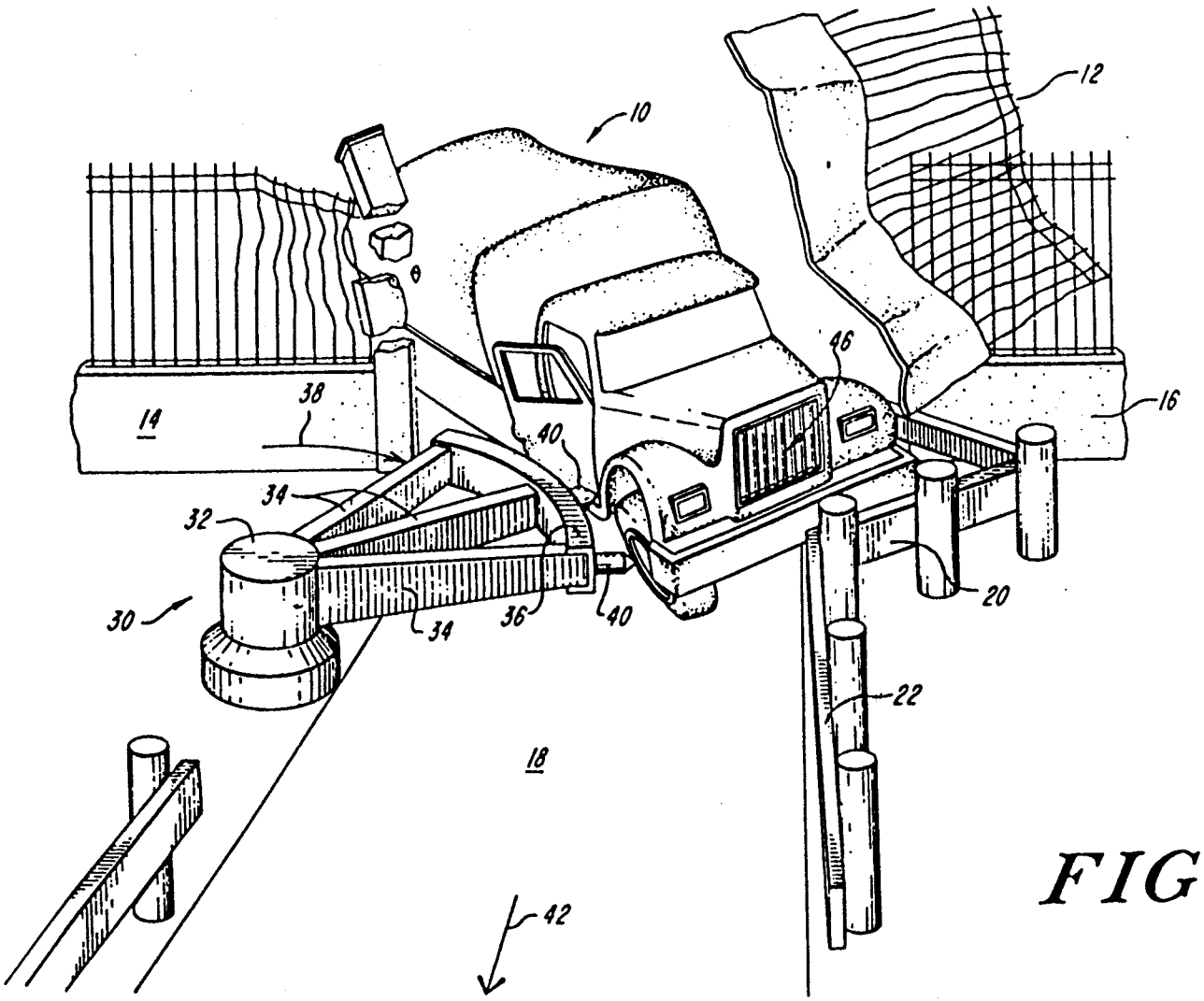
FIG. 1 is a diagrammatic illustration of a vehicle arresting system utilizing a sectored turnstile, illustrating the deflection of an oncoming unauthorized vehicle into a jogged crash-barrier which forms an extension of the guard rail normally utilized.

With respect to terrorist vehicle arresting system per se, a vehicle is deflected sidewards instead of creation a frontal massive barrier. In one embodiment a turnstile/-cam is used, which is a rotating barrier that is maintained hidden and does not move until the moment of the crash attempt. The turnstile can be made to appear invisible, save only for a cable/net being stretched across the driveway, lowered into or raised out of a channel, opened at the roadway surface. A cable is needed only to initiate motion of the turnstile/cam, but not to stop a vehicle. A crashing vehicle impacting the cable, when raised, forces the hidden turnstile/cam out into the driveway in a vehicular diversion system in which the vehicle is diverted to a barrier or a rigid guard rail. A visible concrete crash barrier may utilized or may be eliminated in favor of a straight rigid guard rail. Currently the guard rails presently utilized are government tested and certified in design.

In one embodiment, as will be described, two photo-electric beams are located in the zone of the turnstile, or an electro-magnetic ground-loop in the pavement, to prevent the aforementioned barrier cable from rising during the movement through the turnstile of an authorized vehicle in or out. Rigid barriers now in use have occasionally malfunctioned and have damaged authorized vehicles including that of an ambassador. The turnstile system prevents such an occurrence.

The turnstile serves as a type of anti-terrorist vehicle arresting system for high security check points for Government Agencies or can be utilized whenever an unauthorized vehicle is to be prevented from proceeding down a driveway. In one embodiment, as will be seen, a horizontal cable, up "at the ready," across the driveway is lowered for each vehicle authorized for each passage in or out. This cable can consist of a ¾ inch Kevlar or steel cable with a high breaking strength attached to a 60 degree segment of a wheel or the cam. In the illustrated embodiment, the turnstile is powered by the kinetic energy in the crashing vehicle which strikes the cable/net, the only visible barrier suspended across the driveway. This cable utilizes the kinetic energy of the truck to pull the turnstile/cam out to a position where it deflects the direction of travel of a vehicle into a rigid barrier just off the opposite side of the driveway. In one embodiment, the cable is the only moving part of the barrier and may be quickly lowered for authorized passage, and immediately raised thereafter, irrespective of, or upon the detection of an unauthorized approaching vehicle. In one embodiment, the rope barrier may be a single rope, or, in another embodiment, a double rope may be used with netting between the upper and lower rope as shown hereinafter in FIG. 2. In this embodiment one rope can carry a double electric wire to provide for alarm actuation upon cable severing.

The turnstile/cam is therefore designed never to move until that rare occasion when a vehicle attempts to crash through the gate. This simplifies power for operation, and minimizes motive equipment as well as power.

Two photo-electric beams or an underground electro-magnetic loop in the barrier zone breaks power to the cable-raising mechanism while an authorized vehicle is passing through, thereby avoiding any potential damage to such vehicle. The above-mentioned synthetic cable cannot be cut with knives, scissors or cable cutters except with great difficulty. In one embodiment, the cable is a three strand twisted rope which as mentioned before, can contain insulated electric wire that when cut or severed sounds an alarm.

As will be seen the advantages to the above turnstile gate are that it reduces penetration of the vehicle or its stopping distance beyond the net. Moreover, the vehicle is diverted into a rigid crash-barrier off the driveway. The turnstile can be rotated into a retracted position behind an aesthetic canopy where it is virtually invisible. In one embodiment, the turnstile may be configured so as to eliminate the necessity of providing a second gate in a sally port configuration. Note that all foundations and structures are far enough off the driveway to avoid disruption of underground utilities.

The turnstile, as has been described, diverts the direction of the vehicle to the off-roadway crash bumper or squeezes it against a certified bollard wall. The system therefore reduces the special requirements off the driveway, with the turnstile operating behind but not necessarily in conjunction with a sliding gate. Note that existing aesthetic gates may only be of a light-weight construction in that they are not expected to prevent vehicular penetration.

The sliding gate in the above-embodiment may be light and quickly moveable, but is not necessarily slideably attached to the turnstile for rotating the turnstile upon assault attempt.

The turnstile/cam in an alternative environment may be directly connected to the gate by cable system or rack and pinion arrangement; or by separate motor drives. Note that when using a bollard-wall, this structure involves the displacement of sections to allow for location of permanent crash bumpers with adequate impact resistance near the entry gate position and similarly on the opposite side for the turnstile and its post. In one embodiment, both the pivot point and the turnstile in the face of the crash bumper would be approximately 10 feet from the plane of the gate located at the fence line, with a stopping distance held within 20 feet.

It will be appreciated that the turnstile needs no shock-absorbing mechanism whatsoever since the strength and mass of a crash barrier is employed to absorb the kinetic energy of the vehicle, and since the turnstile deflects it into the crash barrier.

Referring now lo FIG. 1, a vehicle 10 is shown crashing through an optional gate 12 in a gateway between two relatively solid fence portions 14 and 16 which surround a driveway 18. Vehicle 10 is shown redirected towards a crash-barrier portion 20 of guard rail 22, by virtue of a turnstile 30 which is composed of a central cylindrical hub 32 and spokes 34 which position a sector 36 such that upon rotation in the direction of arrow 38 via turnstile rotation means to be described hereinafter, spikes 40 engage a portion of the oncoming vehicle so that the sector rotates from its original direction as illustrated by arrow 42, off of the driveway and into the crash-barrier. Thus the vehicle finally comes to rest as illustrated, blocking the entrance to the driveway.

Figure 2:
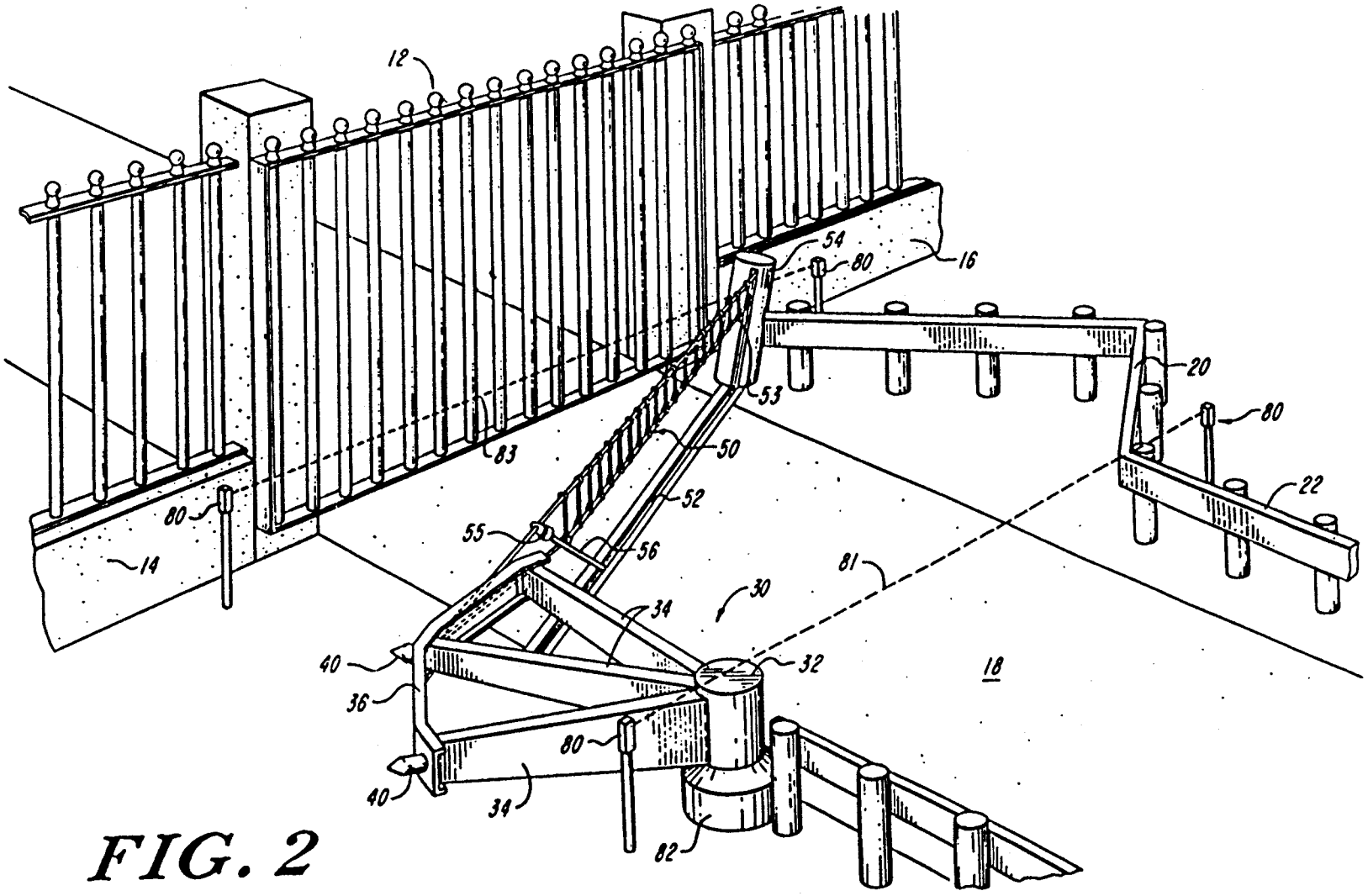
FIG. 2 is a diagrammatic illustration of the raising of a barrier-rope structure from a channel beneath the highway immediately prior to the impact of the vehicle.

It will be appreciated that turnstile 30 may be rotated into a position behind the gateway and camouflaged or can be hidden until it is actuated upon encroachment of an unauthorized vehicle. As will be described, in one embodiment, a cable-net barrier, "at the ready", engages the front portion 46 of the oncoming vehicle. As illustrated in FIG. 2, in which like elements contain like reference characters, it can be seen that one means for rotating turnstile 30 from its rest position is shown by a cable-net 50 which can be lowered and stored in a channel 52 in the surface of the driveway. This barrier rope may be singular or multiple with a net therebetween as shown.

This stored net is raised as shown through the utilization of a inclined and canted power-screw or chain-driven elevator 54 to lower the net down from its rest position, or up from a channel beneath the level of the driveway to a taught position capable of engaging the front portion 46 of the vehicle of FIG. 1. Upon engagement with the net, the turnstile hub 32 revolves around internal bearings such as ball bearings, roller bearings, or friction bearings, which are firmly secured between the hub 32 set within the driveway on a post set in a concrete foundation. As the vehicle moves forward along the driveway, the turnstile is rotated so as to occlude a portion of the driveway, thereby to redirect the vehicle towards the crash barrier portion of the guard rail. It will be appreciated that this crash barrier may be reinforced in any desirable manner or in fact can be reinforced through the utilization of concrete, steel, or like materials, if such is desired.

It will be seen in FIG. 2 that cable-net 50 includes a slack take-up weight 55 which is attached to a pivot arm 56 such that when the net is lowered the weight keeps the rope maintained below grade in channel 52.

As described hereinbefore, the inclination of elevator 54 permits tensioning of the net upon raising net end 53 from its lower initial position to its raised position. This causes the net to become taut, thereby pulling the turnstile into a position where it can deflect or carom the vehicle into the crash barrier. Note, the disabled vehicle is left in the driveway so that it prevents other vehicles from entering down the driveway.

Figure 3A:
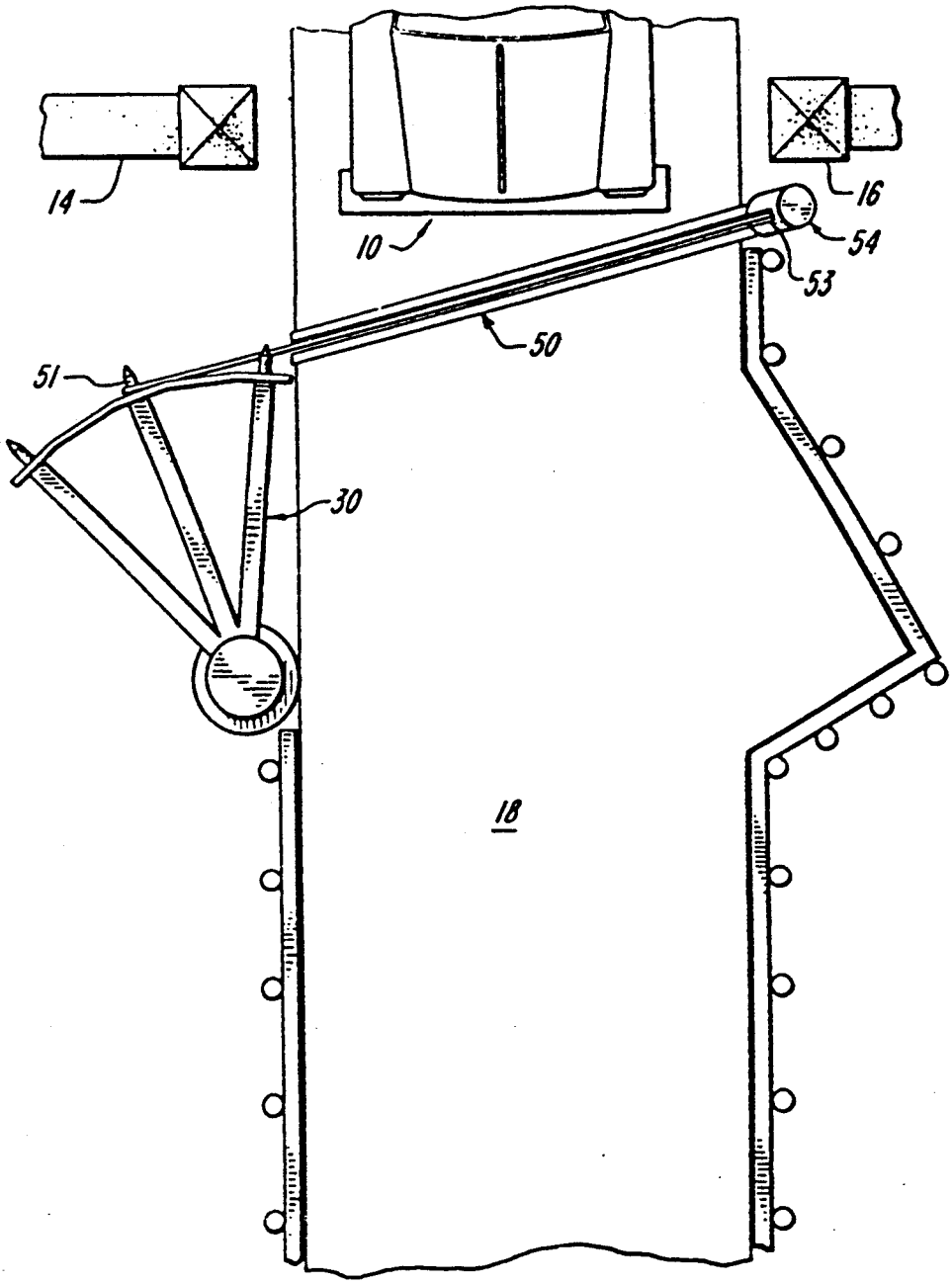
FIGS. 3A, 3B, and 3C are diagrammatic illustrations showing the sequence of events upon the entry of an unauthorized vehicle through a gate illustrating in FIG. 3A the position of the vehicle to just prior to impacting the barrier-rope, in FIG. 3B the penetration vehicle past the barrier-rope showing the initial rotation of the turnstile into the driveway; and with FIG. 3C showing the vehicle deflected into the crash barrier due to the further rotation of the turnstile.
Figure 3B:
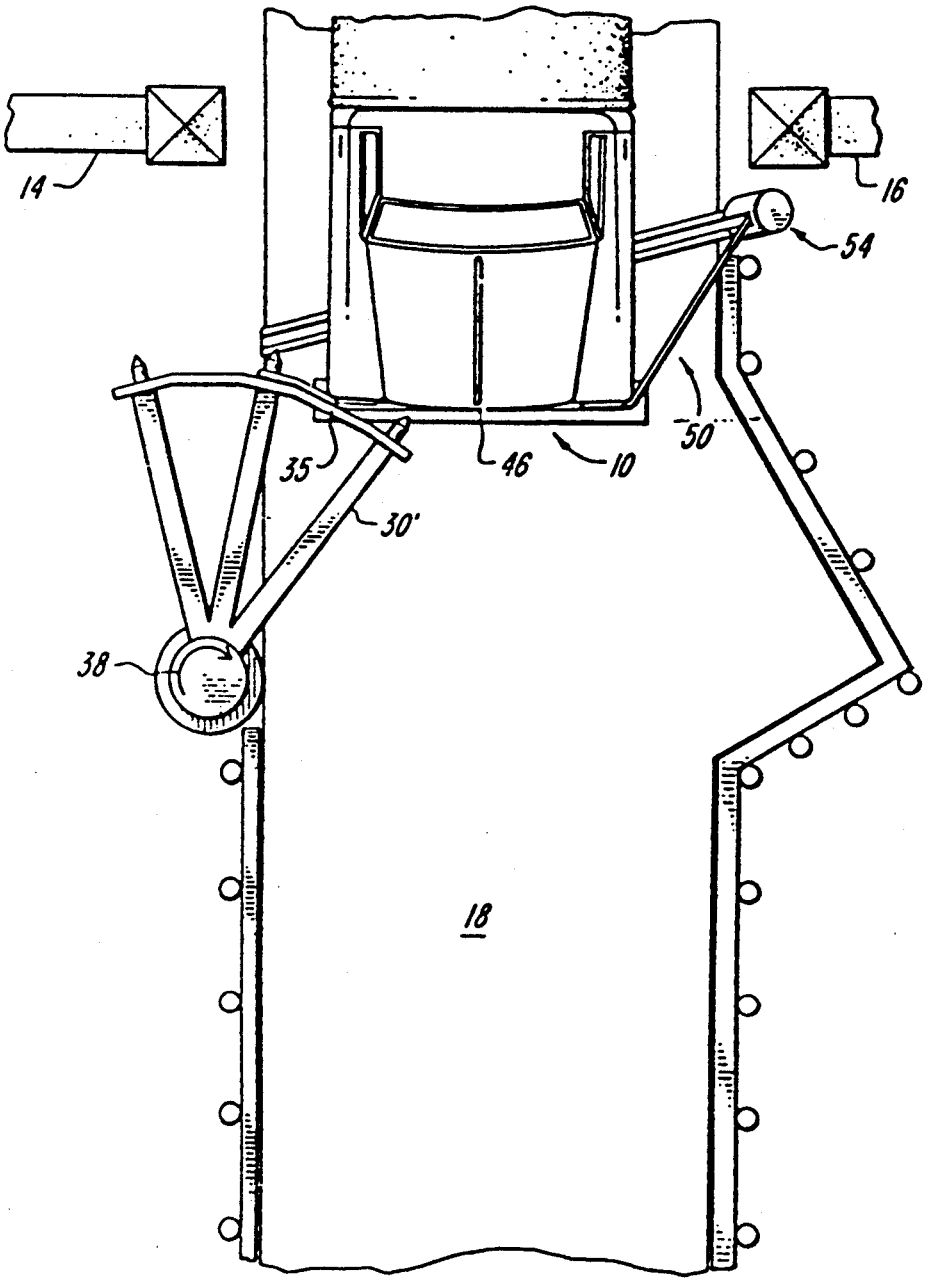
Figure 3C:
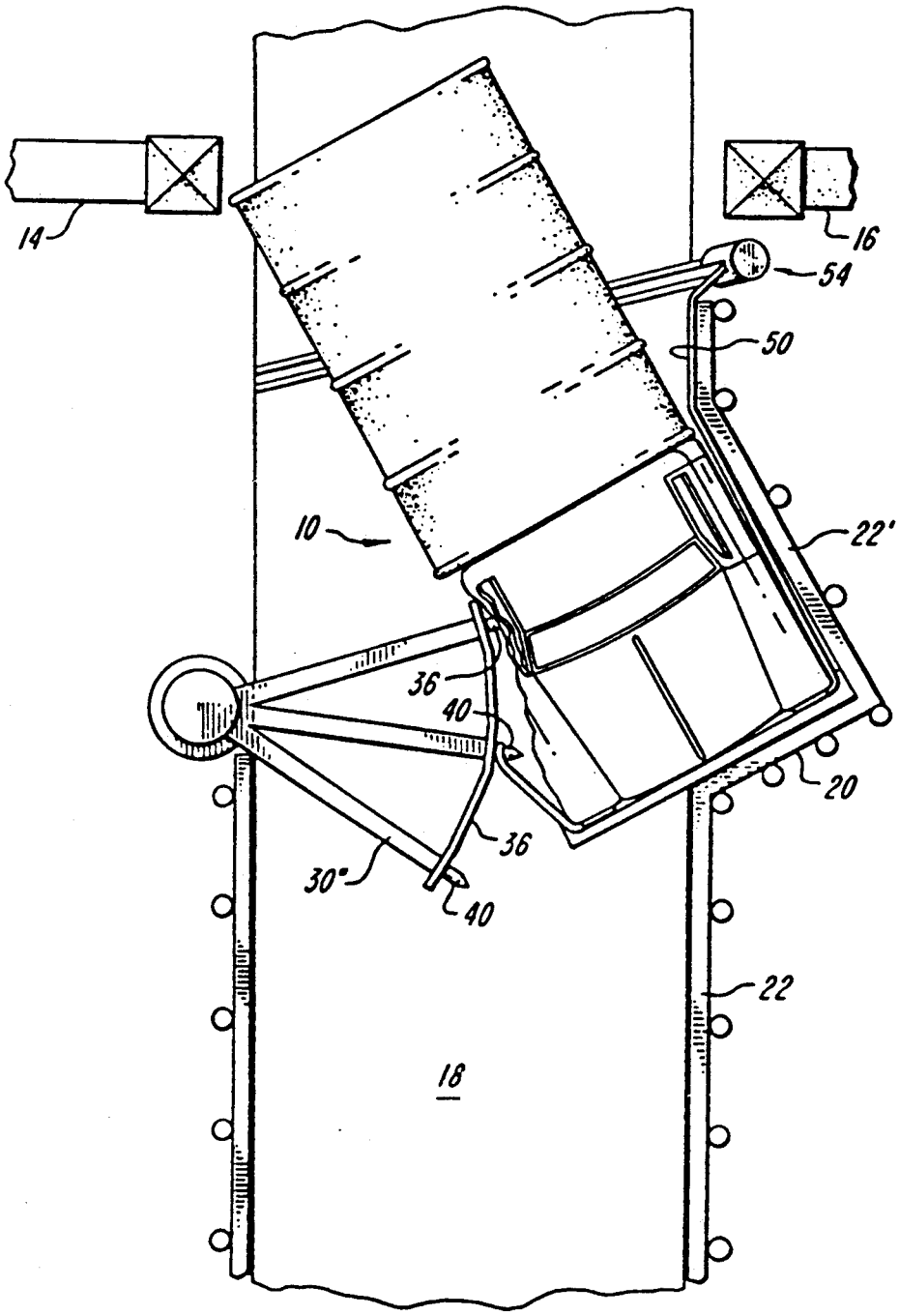

Referring now to FIG. 3A, 3B, and 3C it will be seen that as the truck or other vehicle approaches the gate, the net is "at the ready" position and with the cables being attached to the turnstile at point 51 at one end thereof, and at end 53 to the elevator post 54 at the other end thereof. As the truck progresses through the gate the net lies across the front end 46 of the vehicle for pulling the turnstile so that it rotates, at which point the turnstile engages the truck at the position indicated by reference character 35. As the truck proceeds further down driveway 18 and as illustrated in FIG. 3C, the truck is made to impinge upon barrier portion of guard rail 20, with the side of the truck also being restricted from further lateral movement by guard rail portion 22' caused by the wedging action of the turnstile.

It will be appreciated that while the turnstile is illustrated as having pointed extremities 40, sufficient rotation of sector 36 occurs with or without these points so as to deflect this vehicle from its normal direction into the crash-barrier.

Figure 4:
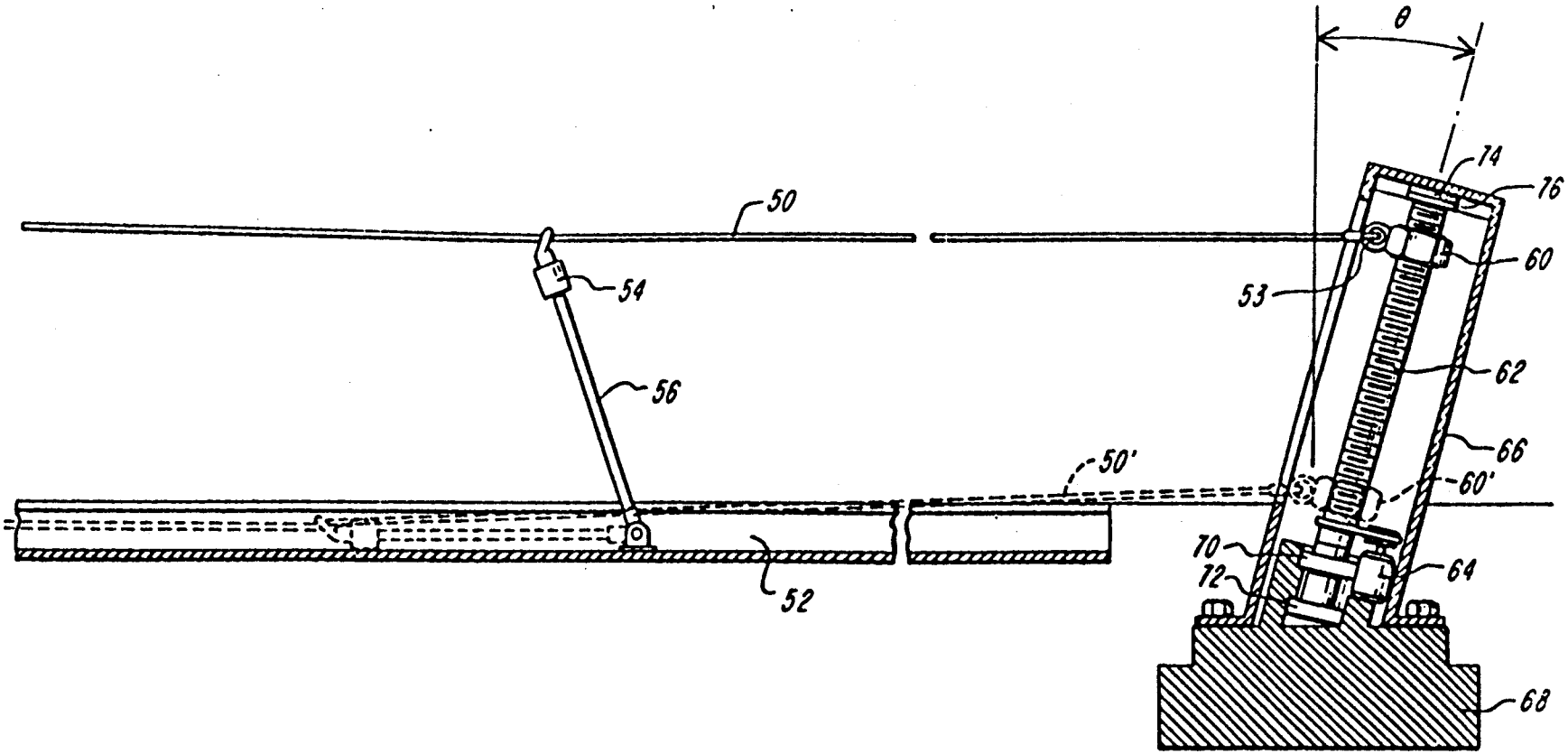
FIG. 4 is a cross-sectional and diagrammatic illustration of the elevator power-screw type actuation for the barrier-rope, also showing the utilization of a weighted hinged idler pulley to maintain the rope in a down position in a channel within the roadway.

Referring now to FIG. 4, in one embodiment the single barrier rope 50 has its end 53 attached to a nut 60 which is threaded to a lead screw 62 actuated by a motor 64 within a housing 66, such that upon actuation of a motor 64, due to the canting of the screw, there is compensation for the change in length of the net between raised and lowered lengths. The canting is illustrated by the angle $\theta$, about 9°, in which the original slack necessary to keep the barrier-rope in channel 52 as shown by dotted outline 50' and 60' is taken up. The rapid rotation of the lead screw raises both the weighted rod 54 and 56 out of channel 52 as well as the net. Note that with gear reducting means being utilized to rapidly rotate the lead screw, such that the barrier-rope may be raised in less than one second. Note also that the lead screw is securely mounted to the housing 66 which is secured to a substantial base 68 so as to be able to withstand the impact of the vehicle crashing through the gateway at least in so far as being able to provide for the movement of the turnstile.

In one embodiment, lead screw is made of steel and is anchored through bearings 70 and 72 to massive base 68. The top part of the lead screw is also secured at its top portion 74 via a bearing 76 to the top portion of housing 66. The housing is secured in position by any appropriate means so as to sustain an angle $\theta$ which in one embodiment is about 9°. It will be appreciated that lever 56 and its corresponding weight 54 may be replaced by a weighted rope having weights strung therealong or a singleweight at one position thereof.

Photo-electric sensors or other means generally indicated by reference character 80 in FIG. 2 may be used to define a zone therebetween in which when actuated and a vehicle breaks beam 81 or 83 all power is cut to the lead screw. This prevents against accidental actuation of the net and turnstile should an authorized vehicle proceed into the protected zone. The provision of a safe zone prevents accidental actuations which may cause random damage to authorized vehicles or at least embarrassment of the persons therein.

With respect to the strength of the turnstile and its ability to withstand impact, it will be appreciated that the dimensions for a turnstile and its base shown in FIG. 2 at reference character 82 are such that the bottom thereof may be anchored to a substantial subsurface concrete base with an upstanding shaft about which are placed bearings such that the entire structure can withstand loading conditions such as may be supplied by kinetic energy of 1,250,000 foot pounds.

ANTIFRICTION IMPROVEMENT

The above has been a description of one type of vehicle deflection system in which a vehicle traveling down a roadway is horizontally or laterally deflected into a crash barrier by virtue of the interpositon of deflection means into the drivway which contacts the forward portion of the vehicle and caroms it or redirects it towards the crash barrier.

In the above system, with the wheels of the vehicle being in contact with the roadway, the wheels track along the roadway. Therefore, there is lateral frictional resistance to sideways deflection. While the system described does work to deflect vehicles, it will be appreciated that the massive nature of the turnstile or deflecting apparatus can be prohibitively expensive and, in certain instances, can result in the vehicle being only partially directed towards the opposing crash barrier.

Figure 5:
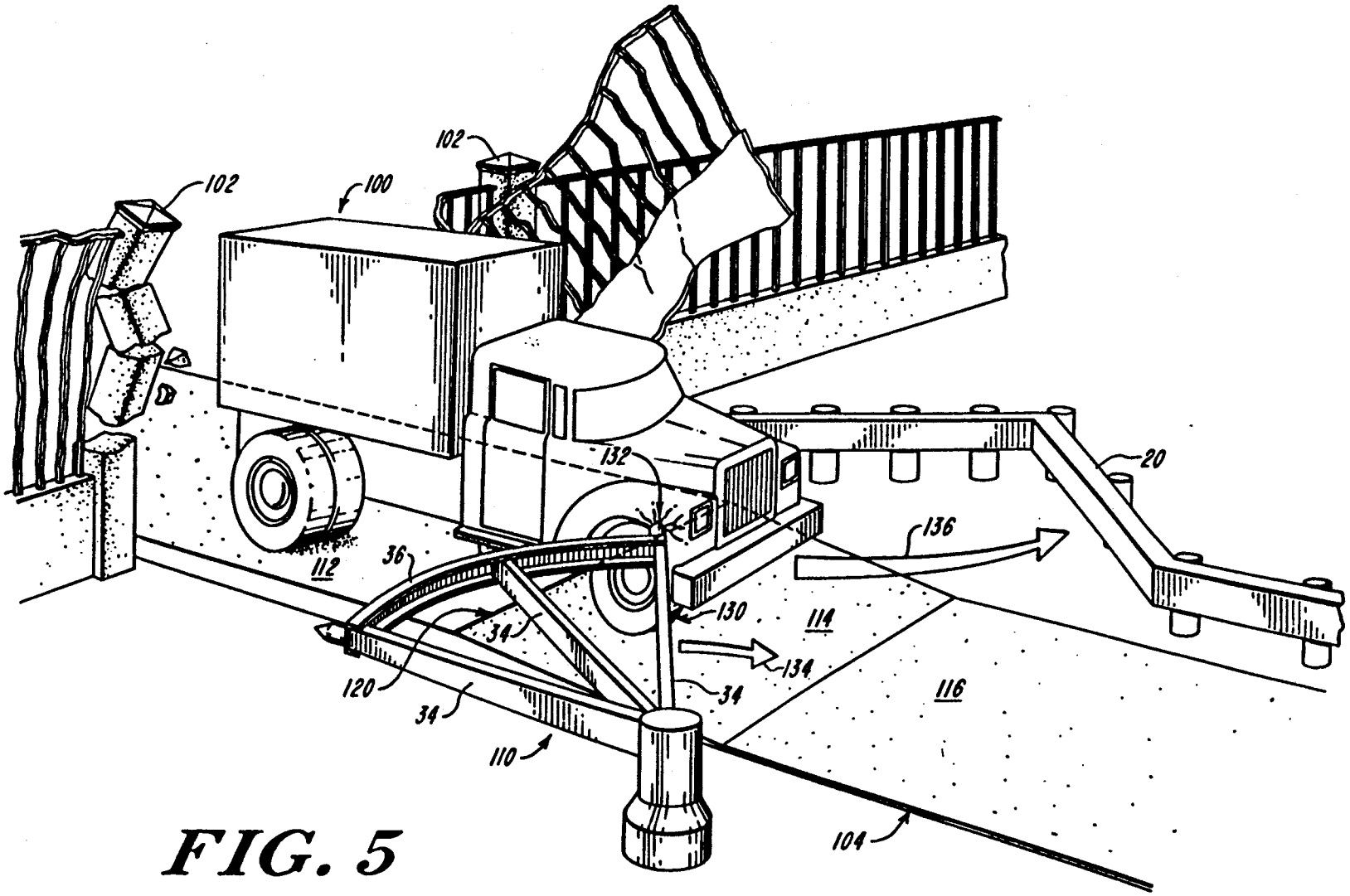
FIG. 5 is a diagrammatic illustration of the subject friction reduction system showing that the front tires of the vehicle leave the driveway during deflection.

Referring now to FIG. 5, in order to improve the certainty of the deflection and in order to be able to decrease the massive nature of the deflection apparatus, as can be seen, a vehicle 100 has travelled through a gate structure 102 down a driveway 104 towards deflection means 110 which in the pictured embodiment is the aforementioned turnstile deflection system, with spokes 34 and sector 36 being as pictured. The crash barrier 20 is the same as that shown in FIG. 1.

It will be seen that roadway 104 has an initial level portion 112, a downwardly sloping portion 114 and a further level portion 116 as illustrated. Sections 112 and 114 form a transverse ridge 120 at their juncture, with portion 114 falling away from the transverse ridge. As described herein before, the ridge and section 114 may be almost imperceptible in that the fall need only be 5 inches in 5–8 feet. However, for a vehicle 100 travelling down roadway 104 at a speed greater than normal, it can be seen that the front wheels 130 leave the surface of the driveway such that the front wheels of the vehicle are in mid air at the point 132 where the first portion of the deflecting means impacts the forward portion of the vehicle. The deflection means operates in the direction of arrow 134 to deflect the vehicle in the direction of arrow 136 into crash barrier 20. Because there is no friction, the vehicle pivots on its rear wheels with great ease.

Experimental evidence shows from tire marks on flat pavement, that the front wheel resistance is significant in the FIG. 1 system involving a flat driveway. Here the effect of front wheel friction is made negligible. The result is that the spokes, sectors and hub of the turnstile type deflector can be reduced in mass.

Figure 6A:
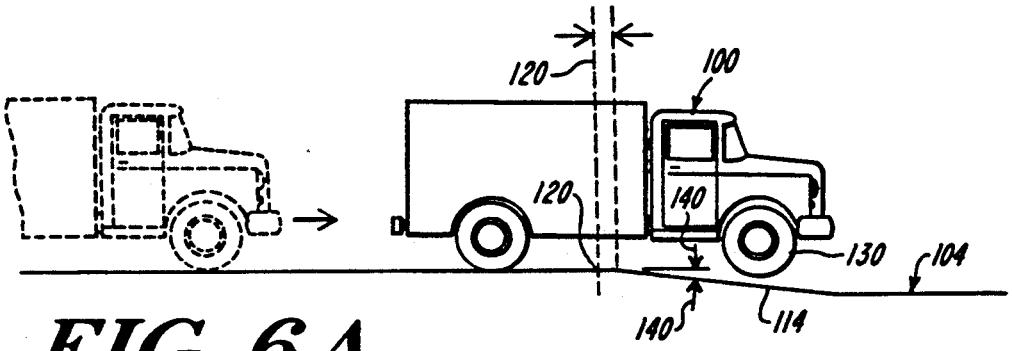
FIG. 6A, B, and C, are side diagrammatic views of different embodiments of the subject invention.

Referring now to FIG. 6A, vehicle 100 is shown with front wheels 130 clearly above and out of contact with the surface of section 114 of roadway 104. It will be seen that the angle of drop illustrated by arrows 140 is optimal in that it corresponds to a drop of 5 inches in 5–8 feet from ridge 120.

Figure 6B:
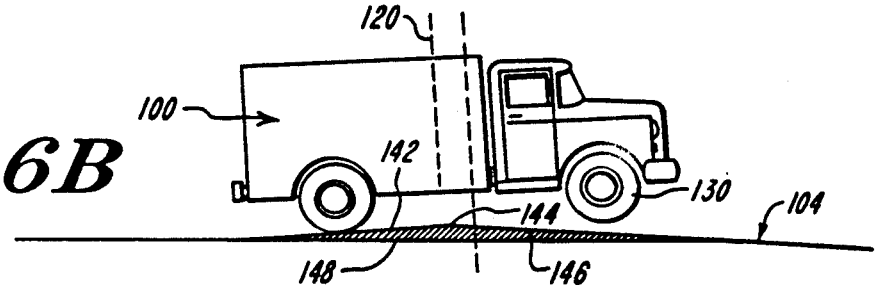

Referring to FIG. 6B, should it be inconvenient to provide the present driveway with such a configuration, it is possible to provide a upwardly sloping section of the driveway 142 and a ridge 144 with a downwardly sloping portion of the driveway 146 contiguous thereto. To accomplish this macadam or concrete can be built up on top of the already existing driveway 104 as illustrated by shaded portion 148. In both the FIG. 6A and FIG. 6B cases, the amount of rise and fall of the driveway is so slight that it is imperceptible to the casual observer. This means that to the casual observer, no particular precautions are being taken and, therefore, there is no indication to the terrorist to slow his vehicle for preventing his tires from coming off of the roadway. Note, at slower speed, wheels offer less frictional resistance, and the wheels have more time to turn in the direction of the deflection. At the relatively high rates of speed of terrorist vehicles, sideways resistance is higher which creates the need for the Subject friction reducing system.

Figure 6C:
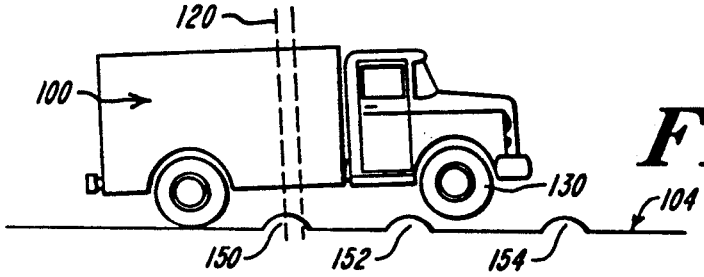

As shown in FIG. 6C, another imperceptible but effective manner of providing that the front tires of vehicle 100 leave roadway 104 is to provide traditional speed bumps 150, 152, and 154 spaced from each other. While a single speed bump is effective to cause the lifting of the front tires, multiple speed bumps provide such an oscilatory motion that should the tires hit the pavement after the first bump, it is immediately projected upwardly. Thus, the front tires are made to be airborne for a considerably longer period of time than the single speed bump case. Because speed bumps are typically used to slow down traffic, multiple speed bumps do not necessarily signal a particular type of protection system guarding the roadway.

Figure 7:
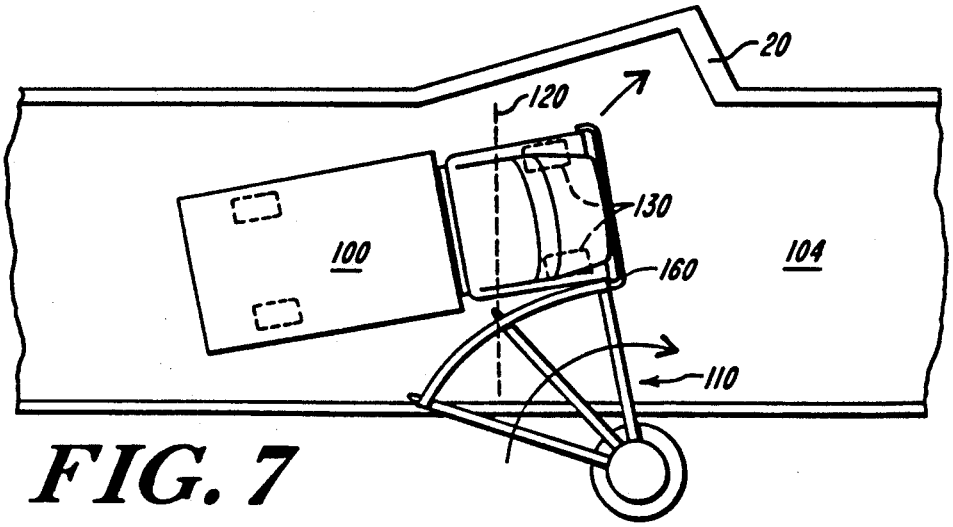
FIG. 7 is a top view illustrating horizontal vehicle deflection.

Referring to FIG. 7, a top view of the deflection of vehicle 100 is illustrated in which it can be seen that the deflection point 160 is down the roadway from ridge 120.

It will be appreciated that the positioning of the impact point is at the ridge of the ramp. However, the impact point may be slightly after the ridge so as to provide impact when the front wheels of the vehicle are airborne. The deflection is virtually instantaneous such that a wide variety of deflection apparatus can be used. For instance, a hydraulically actuated battering ram can be utilized to horizontally deflect the vehicle. On the other hand, turnstile deflection is adequate with a sector caroming the vehicle into the crash barrier. As a result, the wheels only have to be in the air less than a second for adequate "flight time".

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. A system for deflecting a terrorist vehicle so that the terrorist vehicle is prevented from proceeding down a driveway comprising:

a crash barrier to one side of said driveway;

means for deflecting an oncoming vehicle away from its original direction of travel and into said crash barrier;

means for removably positioning said deflecting means in said driveway including means for removing said deflecting means from a position in the driveway for normal vehicular traffic; and, means for causing the front wheels of said vehicle to leave the driveway just prior to impact of said deflecting means with said vehicle.

2. The system of claim 1 wherein said means for causing the front wheels of said vehicle to leave the driveway includes a ramp.

3. The system of claim 2 wherein said ramp includes a portion descending from the level of the driveway.

4. The system of claim 2 wherein said ramp includes a portion which rises above the level of the driveway and a portion which descends to the level of the driveway.

5. The system of claim 1 wherein said means for causing the front wheels of said vehicle to leave the driveway includes at least one bump running transverse to the longitudinal direction of the driveway.

6. The system of claim 5 wherein said last mentioned means includes multiple bumps.

* * * * *